US010976681B1

(12) United States Patent
Sanmonji

(10) Patent No.: US 10,976,681 B1
(45) Date of Patent: Apr. 13, 2021

(54) ALTERNATE BIAS CONTROL OF CHARGING ROLLER AND TRANSFER ROLLER IN IMAGE FORMING APPARATUS

(71) Applicant: TOSHIBA TEC KABUSHIKI KAISHA, Tokyo (JP)

(72) Inventor: Yoshinori Sanmonji, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/816,482

(22) Filed: Mar. 12, 2020

(51) Int. Cl.
*G03G 15/02* (2006.01)
*G03G 15/16* (2006.01)
*G03G 15/06* (2006.01)

(52) U.S. Cl.
CPC ..... *G03G 15/0266* (2013.01); *G03G 15/0225* (2013.01); *G03G 15/0275* (2013.01); *G03G 15/065* (2013.01); *G03G 15/1675* (2013.01); *G03G 2215/1652* (2013.01)

(58) Field of Classification Search
CPC ..... G03G 15/0266; G03G 15/065; G03G 15/1675; G03G 15/0225; G03G 2215/1652; G03G 15/0275; G03G 21/0094; G03G 21/06; G03G 21/08
USPC ..... 399/128
See application file for complete search history.

(56) References Cited

U.S. PATENT DOCUMENTS

| | | | | |
|---|---|---|---|---|
| 6,173,135 | B1 * | 1/2001 | Yuminamochi | G03G 15/168 399/101 |
| 10,036,973 | B1 | 7/2018 | Sanmonji | |
| 2017/0090333 | A1 * | 3/2017 | Ikeda | G03G 15/0225 |
| 2018/0210365 | A1 * | 7/2018 | Sanmonji | G03G 15/0258 |

* cited by examiner

*Primary Examiner* — Walter L Lindsay, Jr.
*Assistant Examiner* — Laura Roth
(74) *Attorney, Agent, or Firm* — Kim & Stewart LLP

(57) ABSTRACT

An image forming apparatus includes a photosensitive drum, a charging roller, a transfer roller, and a control circuit. The control circuit is configured to perform an alternating bias control. During the alternating bias control, the control circuit causes the charging roller and the transfer roller to rotate in accordance with a rotation of the photosensitive drum, and controls the charging roller to alternately turn off and on to a first bias of a predetermined polarity and the transfer roller to alternately turn off and on to a second bias of the predetermined polarity, such that at least a part of a region of the photosensitive drum biased by the first bias is not biased by the second bias, and that at least a part of a region of the photosensitive drum biased by the second bias is not biased by the first bias.

18 Claims, 8 Drawing Sheets

| | OUTPUT OF CHARGING ROLLER | | | OUTPUT OF DEVELOPING ROLLER | OUTPUT OF TRANSFER ROLLER |
|---|---|---|---|---|---|
| | DC | AC(Vpp) | FREQUENCY | | |
| DURING PRINTING OPERATION | −600V | 1.5KV | 1.5KHz | −430V | +700V |
| DURING NON-PRINTING OPERATION | −600V | 1.2KV | 1.5KHZ | −430V | +100V |
| DURING CHARGING ROLLER CLEANING CONTROL OPERATION | 0V/−1.3KV | — | — | −20V | −1.3KV/0 |

ALTERNATE BIAS CONTROL OF CHARGING ROLLER AND TRANSFER ROLLER IN IMAGE FORMING APPARATUS

FIELD

Embodiments described herein relate generally to an image forming apparatus and a method for controlling the same.

BACKGROUND

A photosensitive drum of an image forming apparatus deteriorates by discharge. Therefore, when image formation is not performed (hereinafter referred to as a "during non-image formation"), the discharge may not be performed. In this case, a surface potential of the photosensitive drum may become low, and thus a repulsive force between the photosensitive drum and residual toner on the photosensitive drum may decrease. When the photosensitive drum is driven and rotated in this state, a small object (hereinafter referred to as a "contaminant") on the photosensitive drum may pass through a cleaning blade and reach a charger. Thus, in the case of an image forming apparatus employing a contact-roller-type charging, the contaminant may adhere to a charging roller, and thus the charging roller may be contaminated. The contaminant referred to herein is, for example, paper powder and an external additive component included in residual toner.

A general method of removing the contaminant adhering to the charging roller is to remove the contaminant by causing a cleaning member such as a bristle brush to contact the charging roller. However, according to this method, the contaminant may enter minute unevenness on a surface of the charging roller. In addition, this method requires the cleaning member, which leads to cost increase.

DETAILED DESCRIPTION

Embodiments are made in an effort to provide an image forming apparatus and a method for controlling the image forming apparatus capable of improving cleaning performance with respect to a charging roller while suppressing the cost.

In general, according to an embodiment, an image forming apparatus includes a photosensitive drum, a charging roller, a transfer roller, and a control circuit. The charging roller is configured to charge the photosensitive drum and rotate in accordance with the rotation of the photosensitive drum. The transfer roller is configured to receive a toner image formed on the photosensitive drum and rotate in accordance with the rotation of the photosensitive drum. The control circuit is configured to perform an alternating bias control. During which the control circuit causes the charging roller and the transfer roller to rotate in accordance with the rotation of the photosensitive drum, and controls the charging roller to alternately turn off and on to a first bias of a predetermined polarity and the transfer roller to alternately turn off and on to a second bias of the predetermined polarity, such that at least a part of a region of the photosensitive drum biased by the first bias of the charging roller is not biased by the second bias of the transfer roller, and that at least a part of a region of the photosensitive drum biased by the second bias of the transfer roller is not biased by the first bias of the charging roller.

Hereinafter, an image forming apparatus and a control method according to an embodiment will be described with reference to the drawings.

Figure 1:
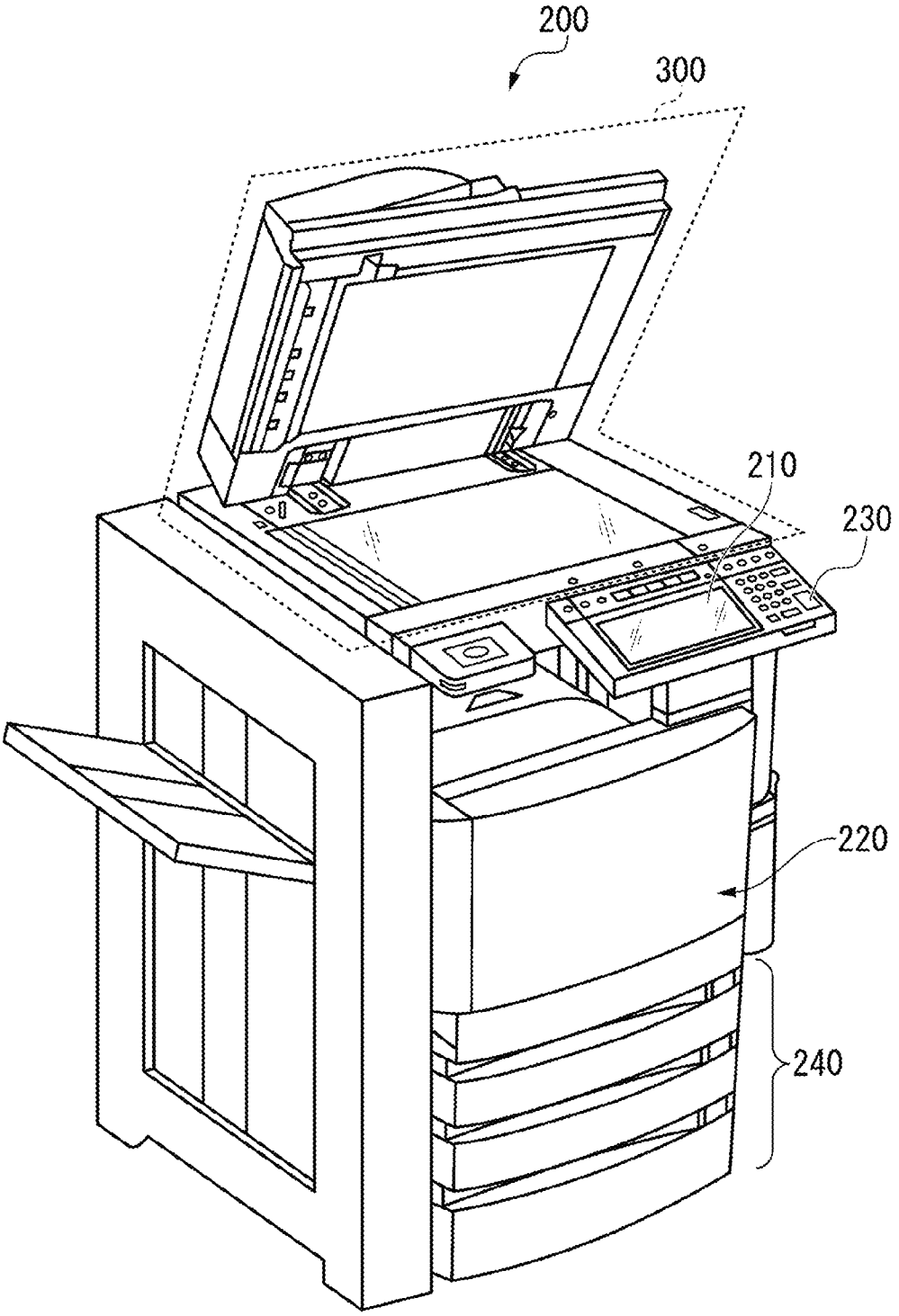
FIG. 1 illustrates an external view of an example of an image forming apparatus according to an embodiment.

FIG. 1 illustrates an external view of an example of an image forming apparatus 200 according to an embodiment. The image forming apparatus 200 is, for example, a multi-function peripheral (MFP). The image forming apparatus 200, for example, reads an image displayed on a sheet, generates digital data, and generates an image file. The image forming apparatus 200 forms an image on another sheet with a developer such as toner. The sheet is, for example, paper or label paper. The sheet may be any material as long as the image forming apparatus 200 can form the image on the surface thereof.

As illustrated in FIG. 1, the image forming apparatus 200 includes a display 210, a printer unit 220, a control panel 230, a sheet storage unit 240, and an image reading unit 300.

The display 210 is an image display device such as a liquid crystal display and an organic electro luminescence (EL) display. The display 210 displays various pieces of information on the image forming apparatus 200.

The printer unit 220 forms an image on the sheet based upon image information generated by the image reading unit 300 or image information acquired via a communication path. The printer unit 220 forms the image by, for example, the following processing. The printer unit 220 forms an electrostatic latent image on an image carrier 12 (a photosensitive drum) which will be described below based upon the image information. The printer unit 220 forms a visible image by attaching a developer to the electrostatic latent image. A specific example of the developer is toner. The printer unit 220 transfers the visible image to the sheet. The printer unit 220 fixes the visible image on the sheet by heating and pressing the sheet. The sheet on which the image is formed may be a sheet stored in the sheet storage unit 240, and may be a sheet placed on a manual paper feeding unit 34.

The control panel 230 includes a plurality of buttons. The control panel 230 receives a user operation. The control panel 230 outputs a signal in response to the operation performed by the user to a control unit 311 (e.g., processor or control circuit), which will be described below, of the image forming apparatus 200. The display 210 and the control panel 230 may be formed as an integrated touch panel.

The sheet storage unit 240 stores a sheet to be used for image formation in the printer unit 220.

The image reading unit 300 reads image information to be read based upon brightness and darkness of light. The image reading unit 300 records the read image information. The recorded image information may be outputted to another information processing apparatus via a network. The recorded image information may be formed as an image on the sheet by the printer unit 220.

Figure 2:
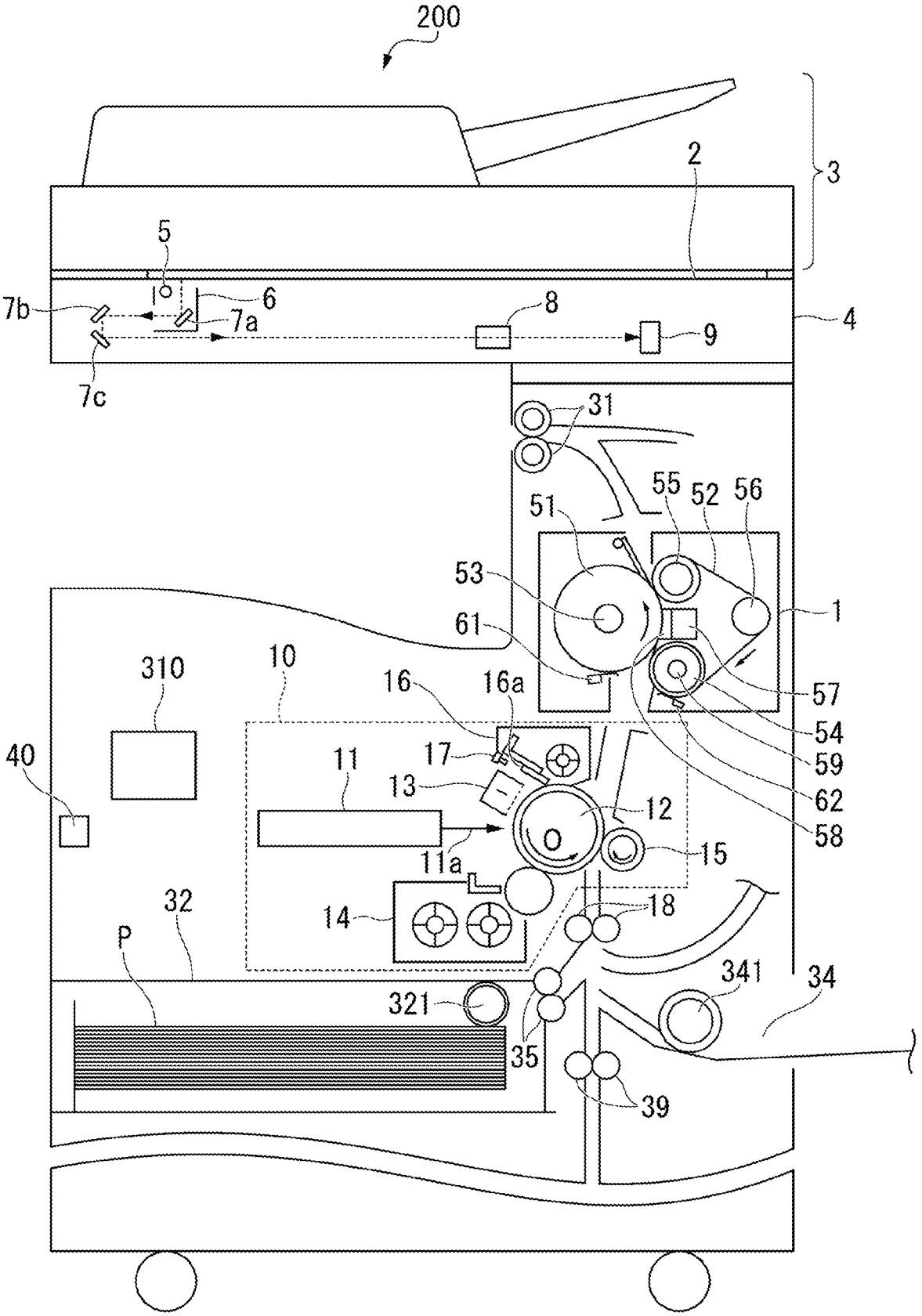
FIG. 2 illustrates a side cross-sectional view of an example of an image forming apparatus according to an embodiment.

FIG. 2 illustrates a side cross-sectional view of an example of the image forming apparatus 200 according to the embodiment. An original platen 2 formed of a transparent material is provided on an upper part of the image forming apparatus 200. The transparent material is, for example, a glass plate. The original platen 2 is for placing an original. An auto document feeder (ADF) 3 is installed to be openable and closable so as to cover the original platen 2. The ADF 3 can scan the original continuously. A scanner 4 that optically reads an image of the original is provided on a lower surface side of the original platen 2. The original to be read by the scanner 4 is the original placed on the original platen 2.

The scanner 4 includes a carriage 6, reflection mirrors 7*a*, 7*b*, and 7*c*, a lens block for variable magnification 8, and a charge coupled device (CCD) 9. For example, the carriage 6 includes a light source 5 that irradiates the original platen 2 with light. The reflection mirrors 7*a*, 7*b*, and 7*c* reflect the light of the light source 5 reflected on the original. The lens block for variable magnification 8 variably magnifies the reflected light.

The carriage 6 is provided to reciprocate along the lower surface of the original platen 2. The carriage 6 moves forward while lighting the light source 5, thereby exposing the original placed on the original platen 2. A reflected light image of the original by the exposure is projected on the CCD 9 via the reflection mirrors 7*a*, 7*b*, and 7*c* and the lens block for variable magnification 8. The CCD 9 outputs an image signal converted into a digital signal to an image processing circuit. The image signal corresponds to a reflected light image of the projected original. The image signal is outputted to a laser scanning unit (LSU) 11 of an image forming unit 10 after image processing is appropriately performed in the image processing circuit.

The image forming unit 10 executes an image forming process for forming a toner image on an image forming medium P. The toner image is an image based upon the image signal outputted from the CCD 9. The image forming medium P is, for example, a sheet such as paper.

Figure 3:
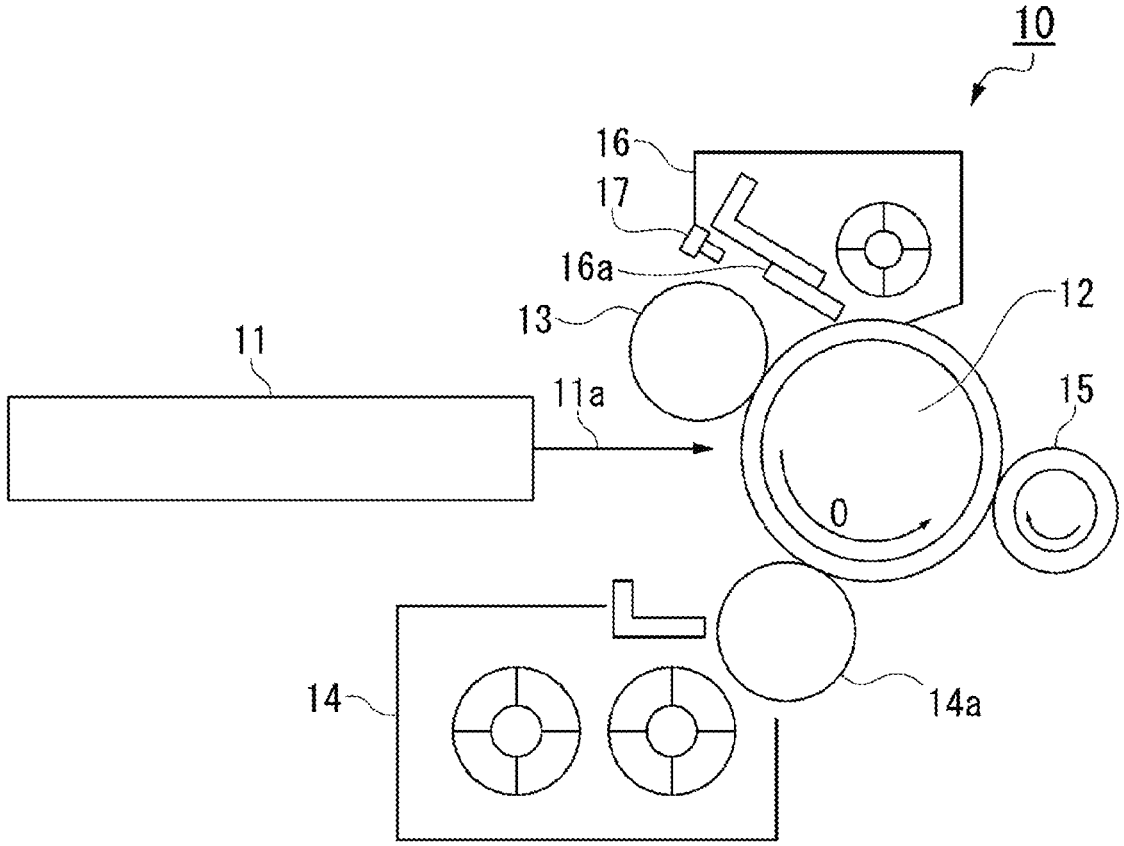
FIG. 3 illustrates an enlarged view of an example of an image forming unit.

FIG. 3 illustrates an enlarged view of the image forming unit 10 illustrated in FIG. 2. The image forming unit 10 includes the image carrier 12, a charging roller 13, the LSU 11, a developing device 14, a transfer roller 15, an image carrier cleaner 16, and a charge removing lamp 17.

The image carrier 12 includes an organic photo conductor (OPC) on the surface. The charging roller 13 uniformly charges the image carrier 12. The LSU 11 forms an electrostatic latent image on the image carrier 12. The developing device 14 includes a developing roller 14*a* for supplying a developer to the image carrier 12 and performing development. The image carrier cleaner 16 removes and collects transfer residual toner, and the like. The charge removing lamp 17, which may be referred to as a discharge lamp, removes the charge on the image carrier 12, that is, discharges the image carrier 12, after the transfer.

The image carrier 12 is, for example, a photosensitive drum that rotates at a peripheral speed of 136 mm/sec. In the examples of FIGS. 2 and 3, the image carrier 12 rotates in a direction of an arrow O. The charging roller 13, the LSU 11, the developing device 14, the transfer roller 15, the image carrier cleaner 16, and the charge removing lamp 17 are arranged in order around the image carrier 12. These are arranged in order along a rotation direction of the image carrier 12.

The charging roller 13 is a roller-type corona charger that abuts on the image carrier 12. The charging roller 13 performs uniform charging of a negative polarity with respect to the image carrier 12. Scanning exposure of a laser beam 11*a* is performed on the image carrier 12 uniformly charged by a laser mounted on the LSU 11. The scanning exposure is performed in response to the image signal obtained by the scanner 4. The scanning exposure is performed with, for example, resolution of 600 dpi (dots per inch). The laser is, for example, a semiconductor laser. By this scanning exposure, the electrostatic latent image is formed on the image carrier 12. The electrostatic latent image formed on the image carrier 12 is developed by the toner of the developing device 14 to be visualized.

A two-component developer is contained in the developing device 14. The two-component developer is formed of a mixture of toner and a magnetic carrier, and is obtained by charging the toner to a negative polarity. The toner has a volume average particle diameter of 5 to 12 μm. The magnetic carrier has a volume average particle diameter of 30 to 80 μm.

The developing device 14 includes a toner concentration sensor (not illustrated). The toner concentration of the two-component developer is detected by the toner concentration sensor. The toner is supplied to the developing device 14 in response to the detection output of the toner concentration sensor. The toner is contained in a toner cartridge (not illustrated).

The image carrier 12 and the developing device 14 are driven at the same timing by a main motor (not illustrated).

The transfer roller 15 is a conductive roller. A transfer bias of a positive polarity is applied to the transfer roller 15 from a high voltage power source. A toner image formed on the image carrier 12 is transferred to the image forming medium P by the transfer roller to which the transfer bias is applied. The image forming medium P is supplied to a paper feeding device 32 and conveyed in timing by a registration roller 18. The toner image transferred to the image forming medium P is fixed by a fixing device 1 and then discharged to the outside of the apparatus by a paper discharge roller 31.

The image carrier cleaner 16 includes an image carrier cleaning blade 16*a*. The image carrier cleaning blade 16*a* contacts a surface of the image carrier 12. The image carrier cleaning blade 16*a* scrapes off the toner remaining on the image carrier 12 after the transfer. The charge removing lamp 17 removes the charge remaining on the surface of the image carrier 12. The image carrier 12 from which the charge is removed is used for forming the next electrostatic latent image.

The paper feeding device 32 includes a cassette. In the paper feeding device 32, the image forming medium P is fed by a pickup roller 321 and a separation and conveyance roller 35. The image forming medium P is fed from the manual paper feeding unit 34 by the pickup roller 341. In addition to the paper feeding device 32, for example, a two-stage paper feeding unit (not illustrated) and a known double-sided paper feeding unit are provided. A separation and conveyance roller 39 is further provided.

The fixing device 1 includes a heat roller 51 and a pressure belt 52. The heat roller 51 is a fixing member formed in a cylindrical shape. The pressure belt 52 is a pressure member that rotates endlessly. The pressure belt 52 abuts on an outer peripheral surface of the heat roller 51 over a predetermined range, thereby forming a fixing nip part. A heat roller lamp 53 is incorporated inside the heat roller 51. The heat roller lamp 53 is a heating source and is formed of a halogen lamp.

The pressure belt 52 is wound around a belt heat roller 54, a pressure roller 55, and a tension roller 56, and stretched. The pressure belt 52 forms a fixing nip part between the belt heat roller 54 and the pressure roller 55. The belt heat roller 54 is located on the upstream side in the conveyance direction. The pressure roller 55 is located on the downstream side in the conveyance direction. The pressure roller 55 forms an exit of the fixing nip part by causing the pressure belt 52 to be pressed against the heat roller 51 and to contact the heat roller 51. A pressure pad holder 57 is disposed inside the pressure belt 52. A pressure pad 58 is held by the pressure pad holder 57. The pressure pad holder 57 presses the pressure pad 58 against an inner peripheral surface of the pressure belt 52 at the center of the fixing nip part, and causes the pressure belt 52 to be pressed against the heat roller 51 and to contact the heat roller 51.

The belt heat roller 54 is formed in a hollow roller shape. A pressure belt lamp 59 is incorporated in the belt heat roller 54. The pressure belt lamp 59 is a heating source and is formed of, for example, a halogen lamp. A fixing member thermistor 61 contacts the outer peripheral surface of the heat roller 51. The fixing member thermistor 61 detects a surface temperature of the heat roller 51. A pressure member thermistor 62 contacts an outer peripheral surface of the pressure belt 52 in the belt heat roller 54. The pressure member thermistor 62 detects a surface temperature of the pressure belt 52.

The heat roller 51 contacts an unfixed toner image held on paper. The heat roller 51 includes, for example, a fluororesin PFA (tetrafluoroethylene and perfluoroalkyl vinyl ether copolymer) layer as a release layer on a roller base. The pressure belt 52 includes a silicone rubber layer on a belt base. The pressure belt 52 further includes a fluororesin PFA layer as a release layer on the silicone rubber layer.

In the embodiment, the fixing device 1 is a fixing device of a method using the belt heat roller 54 and the pressure belt 52, but may be a fixing device of another method. The fixing device 1 may be, for example, a fixing device of an induction heating (IH) fixing method or a fixing device of an on-demand fixing method.

An image forming control substrate 310 includes the control unit 311 and a memory 312 which will be described below. Various motors, sensors, clutches, and high-voltage power sources are connected to the image forming control substrate 310.

In the embodiment, the image forming apparatus 200 is an image forming apparatus that forms a monochrome image, but may be an image forming apparatus that forms a color image.

Figure 4:
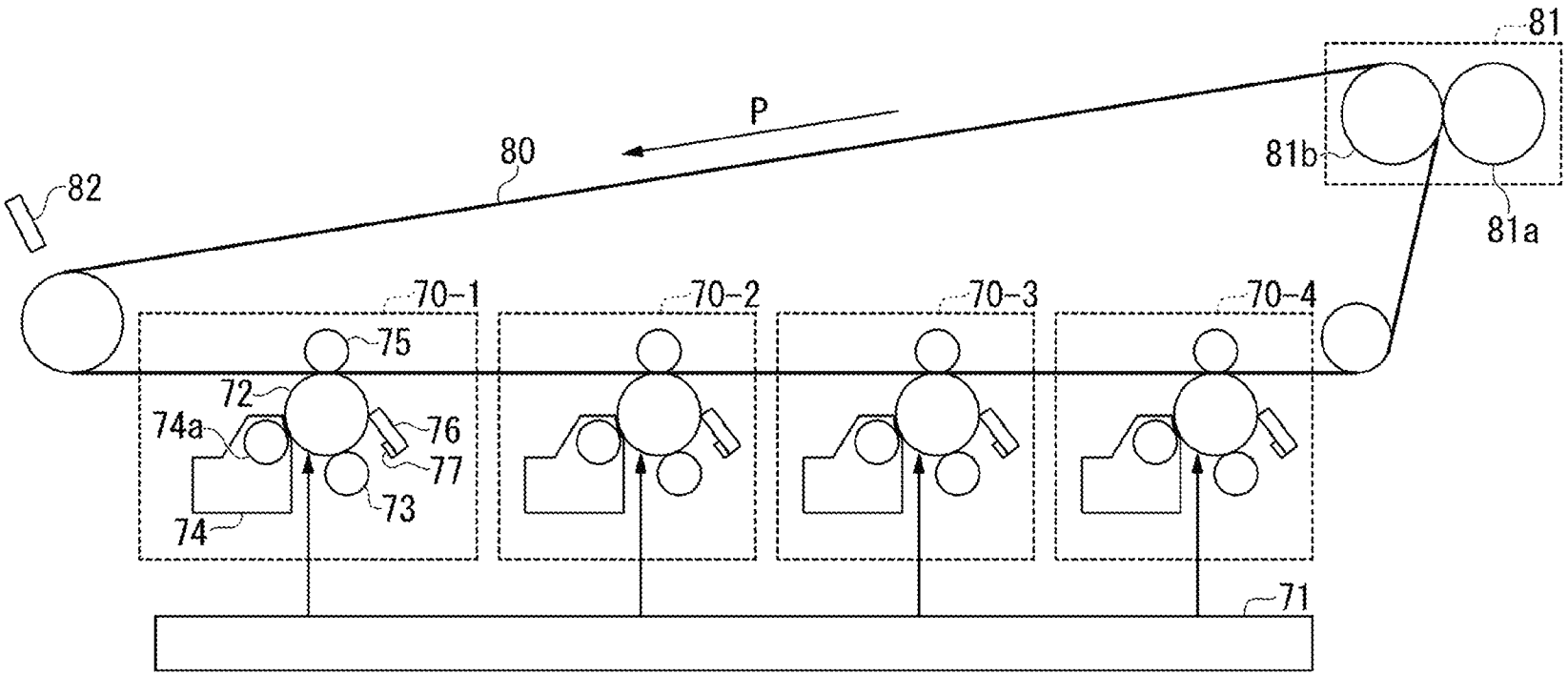
FIG. 4 is a diagram illustrating another example of an image forming unit.

FIG. 4 is a diagram illustrating a configuration example of an image forming unit applicable to an image forming apparatus for forming a color image. As illustrated in FIG. 4, the image forming apparatus includes image forming units 70-1 to 70-4, an LSU 71, an intermediate transfer body 80, a secondary transfer unit 81, and a cleaning blade 82.

The image forming units 70-1 to 70-4 generate toner images with toner of respective colors corresponding to four colors for color printing. The four colors for color printing are yellow (Y), magenta (M), cyan (C), and black (K). The image forming units 70-1 to 70-4 have the same configuration although the toner colors for generating the toner images are different from each other. Hereinafter, the image forming units 70-1 to 70-4 are collectively referred to as an "image forming unit 70".

The image forming unit 70 includes an image carrier 72, a charging roller 73, the developing device 14, the developing roller 14*a*, a primary transfer roller 75, an image carrier cleaner 76, and a charge removing lamp 77.

The LSU 71 irradiates (exposures) the image carrier 72 of the image forming unit 70 with light. The intermediate transfer body 80 is an endless belt. The intermediate transfer body 80 rotates in a direction of an arrow P in FIG. 4. A toner image is formed on a surface of the intermediate transfer body 80. The secondary transfer unit 81 includes a secondary transfer roller 81*a* and a secondary transfer counter roller 81*b*. The secondary transfer unit 81 transfers the toner image formed on the intermediate transfer body 80 to the sheet. The cleaning blade 82 removes toner adhering to the intermediate transfer body 80.

As described above, the toner image formed on the surface of the image carrier 72 is transferred to the intermediate transfer body 80 by the primary transfer roller 75 facing the image carrier 72 (a first transfer process). Next, the toner image formed on the intermediate transfer body 80 is transferred to the sheet by the secondary transfer unit 81 (a second transfer process).

The LSU 71, the image carrier 72, the charging roller 73, the developing device 14, the developing roller 14*a*, the primary transfer roller 75, the image carrier cleaner 76, and the charge removing lamp 77 of the image forming apparatus that forms the color image are functional units respectively corresponding to the LSU 11, the image carrier 12, the charging roller 13, the developing device 14, the developing roller 14*a*, the transfer roller 15, the image carrier cleaner 16, and the charge removing lamp 17 in the above-described image forming apparatus 200 that forms the monochrome image. In the case of the image forming apparatus that forms the color image, a configuration of each image forming unit 70 may be the same as a configuration of the image forming apparatus 200 described hereinafter.

Figure 5:
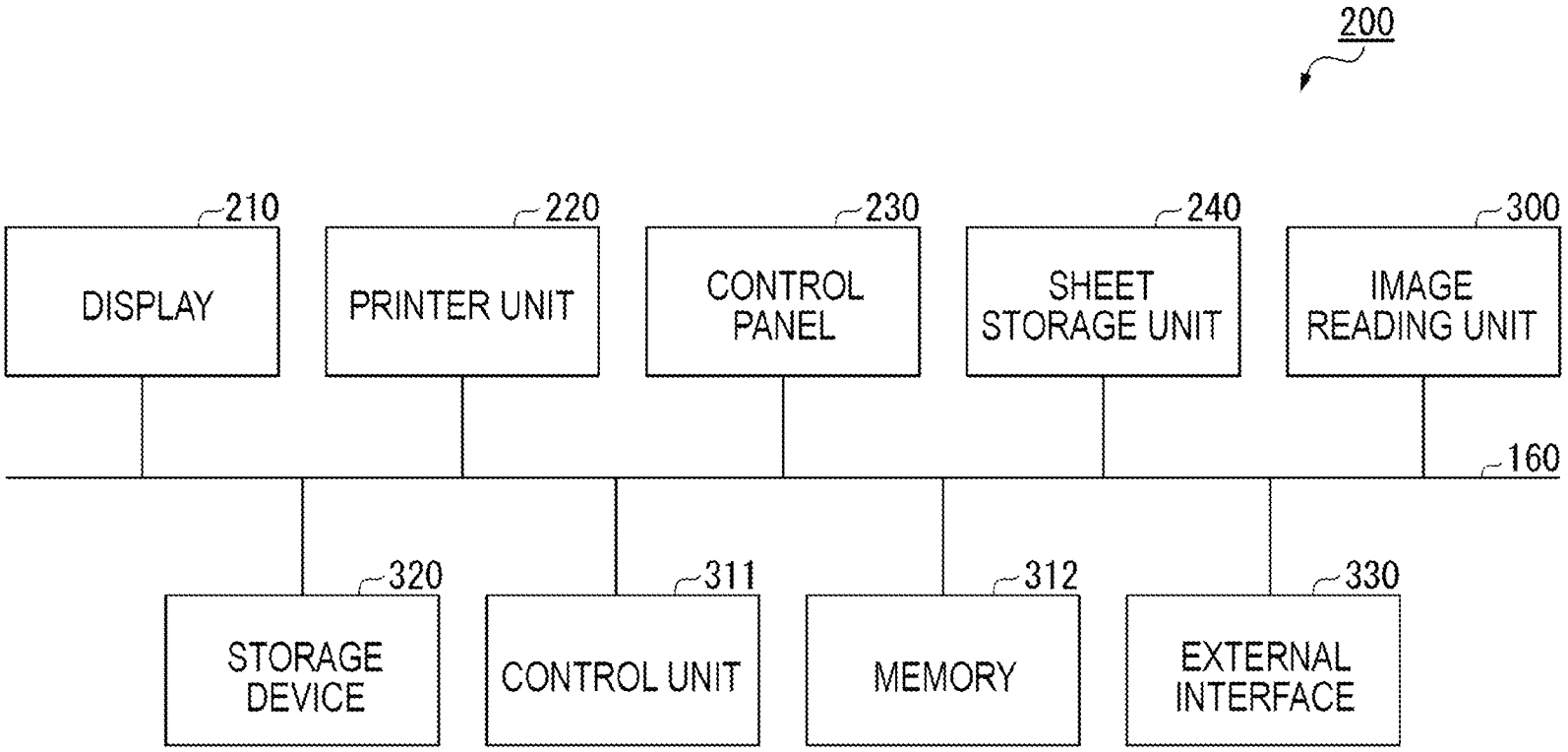
FIG. 5 is a block diagram illustrating a hardware configuration of an image forming apparatus according to an embodiment.

Hereinafter, an example of a hardware configuration of the image forming apparatus 200 will be described. FIG. 5 is a block diagram illustrating the hardware configuration of the image forming apparatus 200 of the embodiment.

The image forming apparatus 200 includes the display 210, the printer unit 220, the control panel 230, the sheet storage unit 240, the image reading unit 300, the control unit 311, the memory 312, a storage device 320, and an external interface 330. Since the display 210, the printer unit 220, the control panel 230, the sheet storage unit 240, and the image reading unit 300 are described above, the description thereof will be omitted. Hereinafter, the control unit 311, the memory 312, the storage device 320, and the external interface 330 will be described. The respective functional units are connected to each other via a system bus 160 so that data communication can be performed.

The control unit 311 controls the operation of each functional unit of the image forming apparatus 200. The control unit 311 loads a software program stored in the storage device 320 onto the memory 312 and executes the software program, thereby executing the processing.

The memory 312 temporarily stores data used by each functional unit provided in the image forming apparatus 200. The memory 312 is, for example, a random access memory (RAM). The memory 312 may store digital data generated by the image reading unit 300. The memory 312 may temporarily store a printing job in which image formation (printing) is performed by the printer unit 220.

The storage device 320 is, for example, a hard disk or a solid state drive (SSD), and stores various pieces of data. The various pieces of data are software programs for controlling the printing job received from the external communication apparatus and the operation of each functional unit of the image forming apparatus 200. The printing job may include image information on an image to be printed on the sheet. The printing job may be a job related to double-sided printing or may be a job related to printing of a plurality of sheets.

Here, specific processing of the control unit 311 will be described with an example. The control unit 311 controls the image formation (printing) on the sheet based upon the printing job received via an external information processing apparatus (for example, a personal computer) or the control panel 230. When receiving the printing job related to the sheet, the control unit 311 acquires image information specified by the printing job. The image information is information on the image to be formed on the sheet.

The control unit 311 controls the sheet storage unit 240. The sheet storage unit 240 feeds the sheet. The control unit 311 controls the printer unit 220. The printer unit 220 forms (prints) the image on the sheet by using the acquired image information.

The external interface 330 transmits and receives data to and from an external apparatus. Here, the external apparatus is an information processing apparatus such as a personal computer, a tablet-type terminal, or a smart device. The external interface 330 operates as an input interface and acquires data or various instructions outputted from the external apparatus. The instruction outputted from the external apparatus is, for example, the printing job. The data outputted from the external apparatus are, for example, image information. The external interface 330 operates as an output interface and outputs the data to the external apparatus.

The above description of the configuration of the image forming apparatus 200 is mainly about the configuration during image formation. Hereinafter, the configuration of the image forming apparatus 200 at the time of cleaning for removing the contaminant adhering to the charging roller 13 will be described. As described hereinafter, the image forming apparatus 200 according to the embodiment performs cleaning of the charging roller 13 (hereinafter referred to as "electrostatic cleaning") by respectively performing output control of the negative polarity on the transfer roller 15 and the charging roller 13.

The electrostatic cleaning is performed, for example, during start processing, stop processing, and non-image formation of the image forming apparatus 200. The electrostatic cleaning is performed, for example, every time a predetermined number of sheets are passed, or every predetermined period that is predetermined in response to an installation environment of the image forming apparatus 200.

For example, during the electrostatic cleaning, the control unit 311 of the image forming control substrate 310 varies the outputs of the LSU 11, the charging roller 13, the developing roller 14*a*, the transfer roller 15, and the charge removing lamp 17 at a predetermined timing.

Hereinafter, an operation sequence during the electrostatic cleaning will be described.

Figure 6:
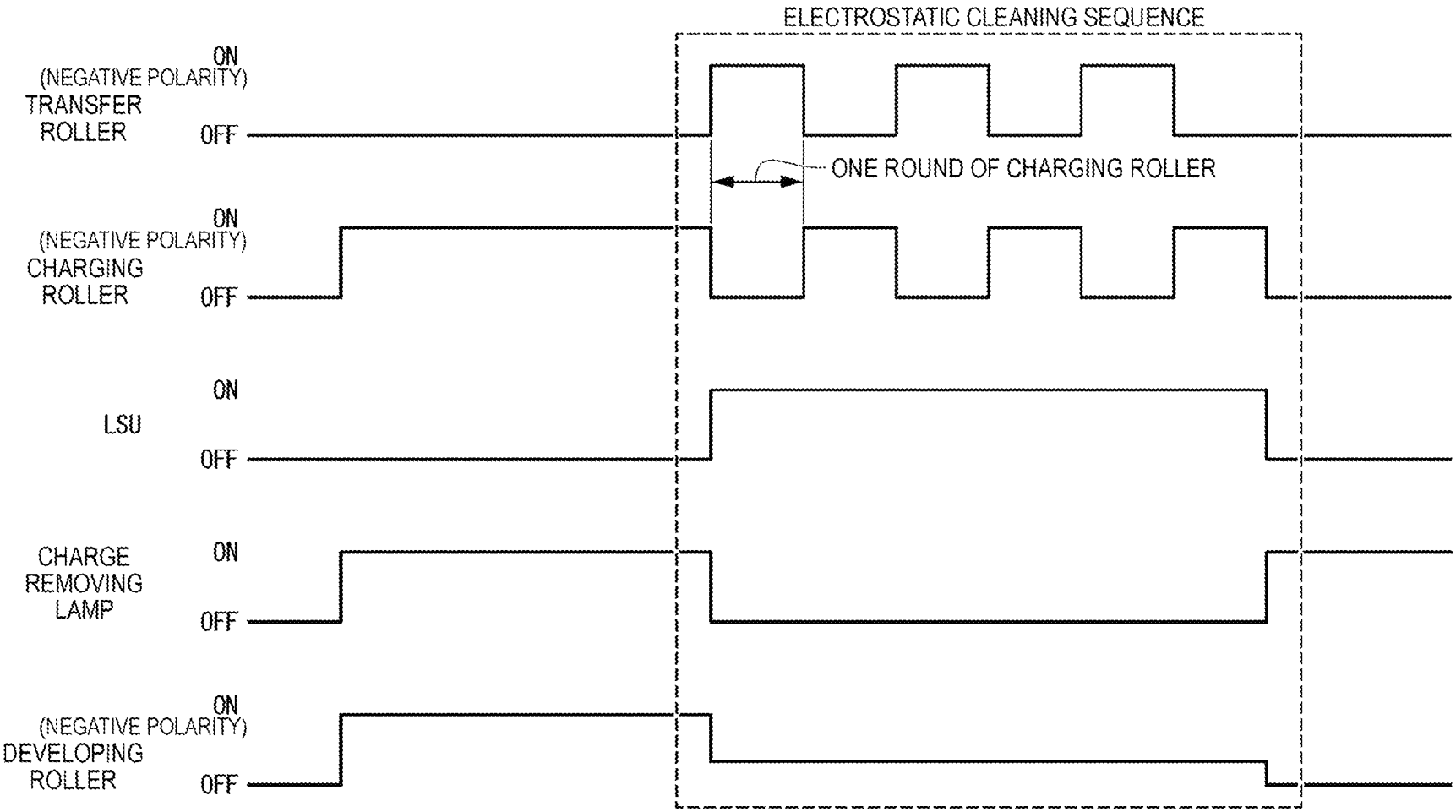
FIG. 6 is a diagram illustrating an operation sequence during electrostatic cleaning.

FIG. 6 is a diagram illustrating the operation sequence during the electrostatic cleaning of the image forming apparatus 200. As illustrated in FIG. 6, during the electrostatic cleaning, the control unit 311 switches on and off the output of the transfer roller 15, for example, at each timing when the image carrier 12 rotates by a length of one round of the charging roller 13. The output of the transfer roller 15 is the output of the negative polarity. As a result, on the surface of the image carrier 12, a region to which a potential is applied and a region to which a potential is not applied are alternately formed for each length of one round of the charging roller 13.

As illustrated in FIG. 6, during the electrostatic cleaning, the control unit 311 switches off and on the output of the charging roller 13, for example, at each timing when the image carrier 12 rotates by the length of one round of the charging roller 13. The output of the charging roller 13 is the output of the negative polarity. At this time, the control unit 311 controls an output timing so that on the surface of the image carrier 12, the output of the charging roller 13 is turned off with respect to the region to which the potential is applied by the transfer roller 15, and the output of the charging roller 13 is turned on with respect to the region to which the potential is not applied by the transfer roller 15.

That is, the control unit 311 performs control so that a phase of an alternating bias output of the transfer roller 15 and a phase of an alternating bias output of the charging roller 13 become opposite to each other. In FIG. 6, in order to make the description easy to understand, a horizontal axis of a graph is not set as a time axis, but is described so as to represent a position of the surface of the image carrier 12. When the horizontal axis is set as the time axis, the positions on the graph where the bias is switched in each member are shifted from each other by the time required for the rotation of the image carrier 12. During the control, for example, the control unit 311 controls the charging roller 13 to alternately turn off and on to a first bias (e.g., −1.3 kV) of a predetermined polarity (e.g., negative polarity) and the transfer roller 15 to alternately turn off and on to a second bias (e.g., −1.3 kV) of the predetermined polarity, such that at least a part of a region of the image carrier 12 biased by the first bias of the charging roller 13 is not biased by the second bias of the transfer roller 15, and that at least a part of a region of the image carrier 12 biased by the second bias of the transfer roller 15 is not biased by the first bias of the charging roller 12.

As illustrated in FIG. 6, during the electrostatic cleaning, the control unit 311 switches off the output of the charge removing lamp 17 and switches on the output of the LSU 11 instead.

In an example of the electrostatic cleaning in a related art, the output of the negative polarity of the transfer roller is always turned on during the electrostatic cleaning, and a potential is uniformly applied to the surface of the image carrier. Next, the potential of the surface of the image carrier becomes in a state of being lowered to the vicinity of 0 volts through a charge removing process by the charge removing lamp. Next, by executing the alternating bias output by the charging roller, the contaminant adhering to the charging roller is moved to the surface of the image carrier, thereby executing the electrostatic cleaning.

However, in the electrostatic cleaning of the related art, the potential of the surface of the image carrier is constant. Therefore, particularly, if the contaminant mixed with a negative electrode and a positive electrode adheres to the charging roller, the best electrostatic cleaning effect cannot be obtained even when the alternating bias output is executed only by the charging roller.

On the other hand, in the image forming apparatus 200 according to the embodiment, as described above, the control unit 311 performs the control so that the phase of the alternating bias output of the transfer roller 15 and the phase of the alternating bias output of the charging roller 13 are opposite to each other. As a result, since a width of the bias that can be alternately switched can be made wider than that of the related art, the effect of the electrostatic cleaning is further enhanced.

The reason why the control unit 311 switches off the output of the charge removing lamp 17 during the electrostatic cleaning is to prevent the charge removal of the surface of the image carrier 12 to which the potential is applied by the alternating bias output by the transfer roller 15. The reason why the control unit 311 switches on the output of the LSU 11 during the electrostatic cleaning is to remove the charge of the surface of the image carrier 12 by the LSU 11 instead of the charge removing lamp 17 according to a fact that the output of the charge removing lamp 17 is turned off. That is, in the image forming apparatus 200 according to the embodiment, the charge removal by the LSU 11 that is a post-process of the charging roller 13 is performed.

As illustrated in FIG. 6, during the electrostatic cleaning, the control unit 311 controls the output of the developing roller 14*a* to be equal to or less than a predetermined value (for example, −40 volts). This is because when the output of the developing roller 14*a* is too high in spite of the charge removal by the LSU 11, a problem such as carrier adhesion occurs. However, since the potential is generally not dropped to 0 volts in the charge removal by the LSU 11, the control unit 311 controls the output of the developing roller 14*a* to be equal to or less than the predetermined value. That is, it is desirable that the predetermined value here is set to a value at which a residual potential after the charge removal by the LSU 11 is approximately removed.

In the embodiment, the alternating bias output by the transfer roller 15 and the charging roller 13 is switched at each timing when the image carrier 12 rotates by the length of one round of the charging roller 13. However, it is not limited to one round of the charging roller 13, and is any round thereof as long as it is equal to or more than one round of the charging roller 13. As described above, the phase of the alternating bias output of the transfer roller 15 and the phase of the alternating bias output of the charging roller 13 may be controlled to be opposite to each other.

It is desirable that in the alternating bias output, the bias is switched at least two times or more so that the contaminant mixed with the negative electrode and the positive electrode adhering to the charging roller moves to the surface of the image carrier 12 more effectively.

During the electrostatic cleaning, it is desirable that the AC output of the charging roller 13 is turned off and only DC output is performed. This is not only to prevent the occurrence of discharge caused by overcurrent due to the AC output, but also to prevent the progress of film abrasion on the surface of the image carrier 12.

Hereinafter, an example of an operation of the image forming apparatus 200 will be described.

Figure 7:
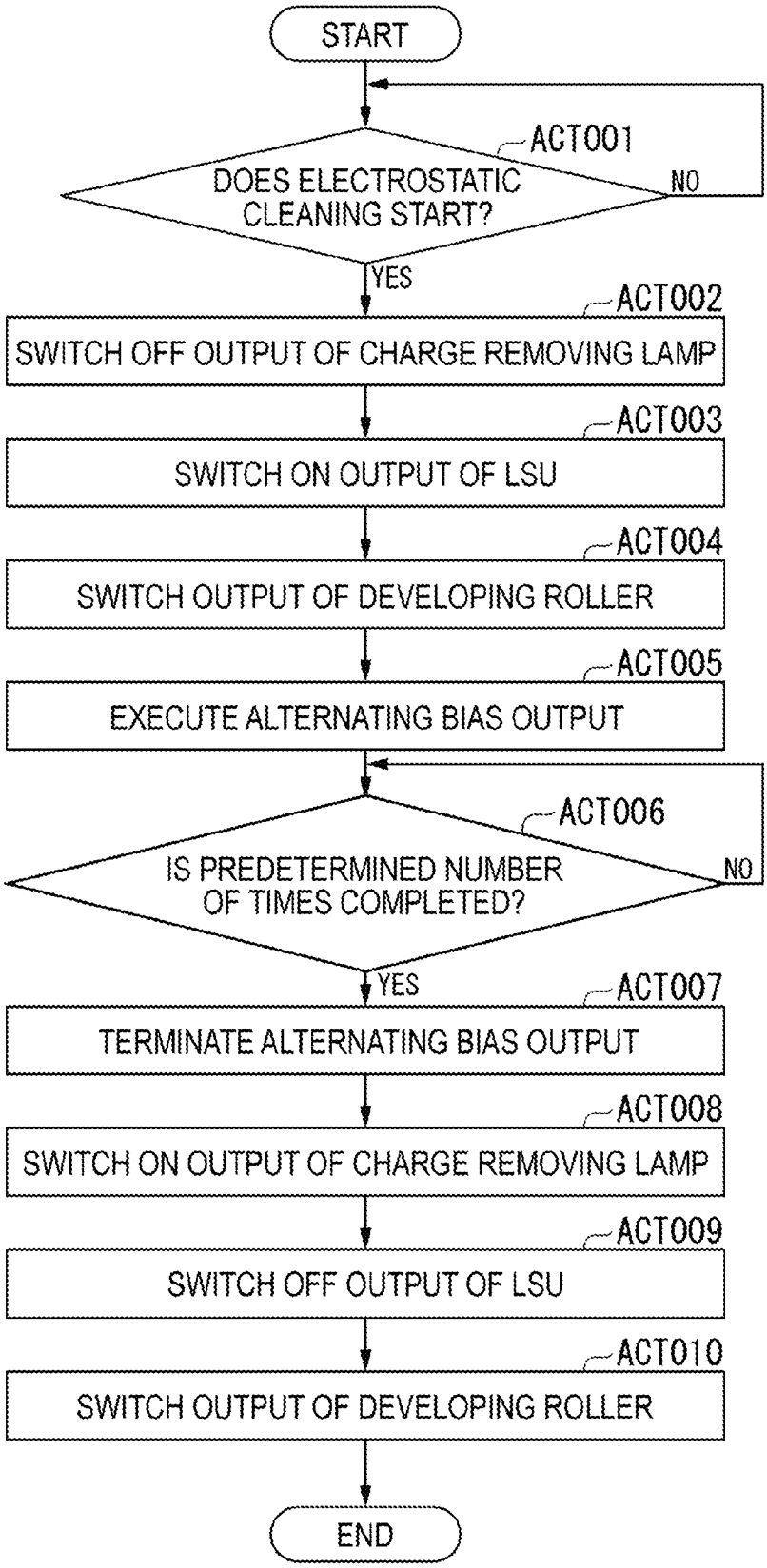
FIG. 7 is a flowchart illustrating an operation during the electrostatic cleaning.

FIG. 7 is a flowchart illustrating an operation during the electrostatic cleaning of the image forming apparatus 200 according to the embodiment.

The control unit 311 of the image forming apparatus 200 waits for an electrostatic cleaning start timing (ACT 001). The electrostatic cleaning start timing is, for example, during start processing, stop processing, or non-image formation of the image forming apparatus 200.

When detecting that the electrostatic cleaning start timing is reached (ACT 001—Yes), the control unit 311 switches off the output of the charge removing lamp 17 (ACT 002). Next, the control unit 311 switches on the output of the LSU 11 (ACT 003). Next, the control unit 311 switches the output of the developing roller 14*a* to be equal to or less than a predetermined value (for example, −40 volts) (ACT 004). The order of the operations of ACTS 002 to 004 described above may be changed or performed simultaneously.

Next, the control unit 311 executes the alternating bias output of the transfer roller 15 and the charging roller 13 (ACT 005). That is, the control unit 311 switches on and off the output of the transfer roller 15, for example, at each timing when the image carrier 12 rotates by the length of one round of the charging roller 13. The control unit 311 switches off and on the output of the charging roller 13, for example, at each timing when the image carrier 12 rotates by the length of one round of the charging roller 13. At this time, the control unit 311 controls the phase of the alternating bias output of the transfer roller 15 and the phase of the alternating bias output of the charging roller 13 to be opposite to each other.

When the alternating bias output of the transfer roller 15 and the charging roller 13 for a predetermined number of times (for example, three times) is completed (ACT 006—Yes), the control unit 311 terminates the alternating bias output (ACT 007).

Next, the control unit 311 switches on the output of the charge removing lamp 17 (ACT 008). Next, the control unit 311 switches off the output of the LSU 11 (ACT 009). Next, the control unit 311 switches off the output of the developing roller 14*a* (ACT 010). The order of the operations of ACTS 008 to 010 described above may be changed or performed simultaneously.

As described above, the operation of the image forming apparatus 200 shown in the flowchart of FIG. 7 is terminated.

Hereinafter, Example will be described.

Figures 8, 9:
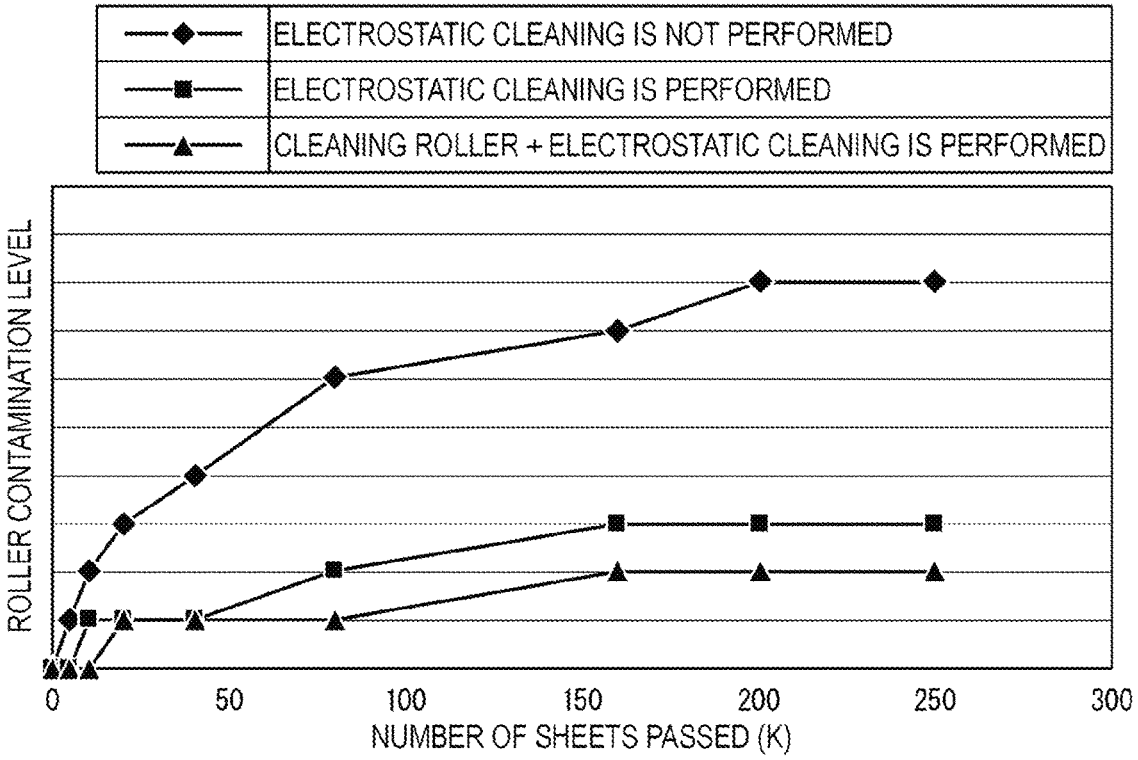
FIG. 8 is a diagram illustrating output setting of an image forming apparatus that was carried out in Example.
FIG. 9 is a diagram illustrating an electrostatic cleaning effect achieved by the image forming apparatus in Example.

FIG. 8 is a diagram illustrating output setting of the image forming apparatus 200 that was carried out in Example. As illustrated in FIG. 8, in Example, during a printing operation (during an image forming operation), the DC output of the charging roller 13 is set to −600 [V], the AC output superimposed thereon is set to 1.5 [KV] (a peak to peak (Vpp) value), and the frequency is set to 1.5 [KHz]. In Example, during the printing operation, the output of the developing roller 14*a* is set to −430 [V], and the output of the transfer roller 15 is set to +700 [V].

As illustrated in FIG. 8, in Example, during a non-printing operation (during a non-image forming operation), the DC output of the charging roller 13 is set to −600 [V], the AC output superimposed thereon is set to 1.2 [KV] (a peak to peak (Vpp) value), and the frequency is set to 1.5 [KHz]. In Example, during the non-printing operation, the output of the developing roller 14*a* is set to −430 [V], and the output of the transfer roller 15 is set to +100 [V].

As illustrated in FIG. 8, in Example, during a charging roller cleaning control operation (during the electrostatic cleaning), the DC output of the charging roller 13 is alternately switched between 0 [V] to −1.3 [KV], and the AC output is turned off. In Example, during the charging roller cleaning control operation, the output of the developing roller 14*a* is set to −20 [V], and the output of the transfer roller 15 is alternately switched between −1.3 [KV] and 0 [V].

FIG. 9 is a diagram illustrating an electrostatic cleaning effect achieved by the image forming apparatus 200 in Example. As illustrated in FIG. 9, a vertical axis of a graph represents a level of contamination of the charging roller 13, and a horizontal axis of the graph represents the number of sheets passed (unit: 1,000 sheets). In the graph of FIG. 9, a dotted line represents a level at which a white stripe image is generated due to the contamination of the charging roller 13. That is, the white stripe image is generated at a level above the dotted line.

FIG. 9 shows an implementation effect in three cases including a case where the electrostatic cleaning according to the embodiment is not performed, a case where the electrostatic cleaning according to the embodiment is performed under the conditions indicated in FIG. 8, and a case where the electrostatic cleaning according to the embodiment is performed under the conditions indicated in FIG. 8 and the cleaning roller is installed in the charging roller 13.

As illustrated in FIG. 9, when the electrostatic cleaning according to the embodiment is not performed, if the number of sheets passed exceeds approximately 8,000, the white stripe image caused by the contamination of the charging roller 13 is generated. On the other hand, when the electrostatic cleaning according to the embodiment is performed, the white stripe image caused by the contamination of the charging roller 13 does not occur even though the number of sheets passed exceeded approximately 25,000. That is, the electrostatic cleaning according to the embodiment makes it possible to perform the paper passing at least three times or more than before without generating the white stripe image. As illustrated in FIG. 9, when the electrostatic cleaning according to the embodiment is performed and the cleaning roller is installed in the charging roller 13, it is possible to further reduce the contamination of the charging roller 13.

As described above, the image forming apparatus 200 according to the embodiment includes the image carrier 12 (photosensitive drum), the charging roller 15, the transfer roller 13, and the control unit 311. The charging roller 15 applies the potential to the surface of the image carrier 12. The transfer roller 15 applies the potential to the surface of the image carrier 12. The control unit 311 performs the alternating bias control for respectively controlling the charging roller 13 and the transfer roller 15 so as to alternately apply the potential to the surface of the image carrier 12 with at least two types of biases during the non-image formation. The control unit 311 controls the charging roller 13 and the transfer roller 15 so that the phase of the bias that is switched in the charging roller 13 and the phase of the bias that is switched in the transfer roller 15 are opposite to each other.

According to the above-described configuration, the phase of the alternating bias output of the transfer roller 15 and the phase of the alternating bias output of the charging roller 13 are opposite to each other. Therefore, the width of the bias that is alternately switched can be made wider than that in the related art. Thus, the effect of the electrostatic cleaning is further enhanced. It is not always necessary to install a cleaning member for removing the contaminant adhering to the surface of the charging roller 13.

As described above, the image forming apparatus 200 according to the embodiment can improve cleaning performance for the charging roller while suppressing the cost.

While several embodiments are described, these embodiments are provided as examples and are not intended to limit the scope of the invention. These embodiments can be implemented in various other forms, and various omissions, substitutions, and modifications can be made without departing from the spirit of the invention. These embodiments and the modifications thereof are included in the scope and gist of the invention, and are also included in the invention described in the claims and the equivalents thereof.

A part of the image forming system 1 in the above-described embodiment may be implemented by a computer. In this case, a program for performing a control function of the computer is recorded on a computer-readable recording medium, and the program recorded on this recording medium is read by a computer system to execute the program, thereby serving as a part of the image forming system 1.

The "computer system" herein is a computer system built in the image forming system 1 and includes software such as an operating system (OS) and hardware such as peripheral devices. The "computer-readable recording medium" indicates a portable medium such as a flexible disk, a magneto-optical disk, a flash memory, an electrically erasable programmable read only memory (EEPROM), a read only memory (ROM), a random access read and write memory (RAM), and a compact disc-read only memory (CD-ROM); a storage devices such as a hard disk built in the computer system; and a storage medium configured by any combination thereof.

The "computer-readable recording medium" may also include one that dynamically stores a program for a short time, such as a communication line when the program is transmitted via a communication network such as the Internet or a communication line such as a telephone line; and one that stores the program for a certain period of time, such as a volatile memory inside the computer system serving as a server or a client at that time. The program may be a program for performing a part of the functions described above, and may be a program that can perform the above-described function in combination with a program already recorded in the computer system.

A part of the image forming system 1 in the above-described embodiment may be implemented by an integrated circuit such as a large scale integration (LSI). Each functional block of the image forming system 1 may be individually made into a processor, or a part or all of the functional blocks may be integrated into a processor. A method of circuit integration is not limited to the LSI, and may be implemented by a dedicated circuit or a general-purpose processor. When an integrated circuit technology that replaces the LSI appears due to the progress of a semiconductor technology, an integrated circuit based upon this technology may be used.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus comprising:

a photosensitive drum;

a charging roller configured to charge the photosensitive drum and rotate in accordance with the rotation of the photosensitive drum;

a transfer roller configured to receive a toner image formed on the photosensitive drum and rotate in accordance with the rotation of the photosensitive drum; and a control circuit configured to perform an alternating bias control, during which the control circuit causes the charging roller and the transfer roller to rotate in accordance with the rotation of the photosensitive drum, and controls the charging roller to alternately turn off and on to a first bias of a predetermined polarity and the transfer roller to alternately turn off and on to a second bias of the predetermined polarity, such that at least a part of a region of the photosensitive drum biased by the first bias of the charging roller is not biased by the second bias of the transfer roller, and that at least a part of a region of the photosensitive drum biased by the second bias of the transfer roller is not biased by the first bias of the charging roller.

2. The image forming apparatus according to claim 1, further comprising:

a discharge lamp configured to discharge the photosensitive drum, the discharge lamp being disposed downstream with respect to the transfer roller and upstream with respect to the charging roller in a rotational direction of the photosensitive drum, wherein the control circuit is further configured to, during the alternating bias control, control the discharge lamp to turn off.

3. The image forming apparatus according to claim 1, further comprising:

a light source configured to irradiate the photosensitive drum, the light source disposed downstream with respect to the charging roller and upstream with respect to the transfer roller in a rotational direction of the photosensitive drum, wherein the control circuit is further configured to, during the alternating bias control, control the light source to continuously irradiate the photosensitive drum.

4. The image forming apparatus according to claim 1, wherein a time period of turn on of the charging roller to the first bias of the predetermined polarity during a single cycle of the alternating bias control is equal to or greater than a time period of one rotation of the charging roller.

5. The image forming apparatus according to claim 1, wherein the control circuit is further configured to perform an image forming control, during which the control circuit controls the transfer roller to be biased to a third bias of a polarity opposite to the predetermined polarity.

6. The image forming apparatus according to claim 1, further comprising:

a developing roller configured to supply toner to the photosensitive drum, the developing roller being disposed downstream with respect to the charging roller and upstream with respect to the transfer roller in a rotational direction of the photosensitive drum, wherein the control circuit is further configured to:

during an image forming control, control the developing roller to be biased to a fourth bias of the predetermined polarity; and during the alternating bias control, control the developing roller to be biased to a fifth bias of the predetermined polarity, an absolute value of the fifth bias being less than an absolute value of the fourth bias.

7. The image forming apparatus according to claim 1, wherein the control circuit performs the alternating bias control when the image forming apparatus starts up.

8. The image forming apparatus according to claim 1, wherein the control circuit performs the alternating bias control during an operation to turn off the image forming apparatus.

9. The image forming apparatus according to claim 1, wherein the control circuit performs the alternating bias control after every image forming of a predetermined number of sheets.

10. A method for controlling an image forming apparatus including a photosensitive drum configured to rotate, a charging roller, and a transfer roller, the method comprising, during an alternating bias control:

causing the charging roller and the transfer roller to rotate in accordance with a rotation of the photosensitive drum; and controlling the charging roller to alternately turn off and on to a first bias of a predetermined polarity and the transfer roller to alternately turn off and on to a second bias of the predetermined polarity, such that at least a part of a region of the photosensitive drum biased by the first bias of the charging roller is not biased by the second bias of the transfer roller, and that at least a part of a region of the photosensitive drum biased by the second bias of the transfer roller is not biased by the first bias of the charging roller.

11. The method according to claim 10, wherein the image forming apparatus further includes a discharge lamp disposed downstream with respect to the transfer roller and upstream with respect to the charging roller in a rotational direction of the photosensitive drum, and the method further comprises, during the alternating bias control, controlling the discharge lamp to turn off.

12. The method according to claim 10, wherein the image forming apparatus further includes a light source disposed downstream with respect to the charging roller and upstream with respect to the transfer roller in a rotational direction of the photosensitive drum, and the method further comprises, during the alternating bias control, controlling the light source to continuously irradiate the photosensitive drum.

13. The method according to claim 10, wherein a time period of turn on of the charging roller to the first bias of the predetermined polarity during a single cycle of the alternating bias control is equal to or greater than a time period of one rotation of the charging roller.

14. The method according to claim 10, further comprising, during an image forming control:

controlling the transfer roller to be biased to a third bias of a polarity opposite to the predetermined polarity.

15. The method according to claim 10, wherein the image forming apparatus further includes a developing roller downstream with respect to the charging roller and upstream with respect to the transfer roller in a rotational direction of the photosensitive drum, and the method further comprises:

during an image forming control, controlling the developing roller to be biased to a fourth bias of the predetermined polarity; and during the alternating bias control, controlling the developing roller to be biased to a fifth bias of the predetermined polarity, an absolute value of the fifth bias being less than an absolute value of the fourth bias.

16. The method according to claim 10, wherein the alternating bias control is performed when the image forming apparatus starts up.

17. The method according to claim 10, wherein the alternating bias control is performed during an operation to turn off the image forming apparatus.

18. The method according to claim 10, wherein the alternating bias control is performed after every image forming of a predetermined number of sheets.

* * * * *